United States Patent [19]

Povio

[11] Patent Number: 4,801,135

[45] Date of Patent: Jan. 31, 1989

[54] SHEET HANDLING APPARATUS

[75] Inventor: Raymond A. Povio, Pittsford, N.Y.

[73] Assignee: Xerox Corporation, Stamford, Conn.

[21] Appl. No.: 64,023

[22] Filed: Jun. 19, 1987

[51] Int. Cl.[4] ..... B65H 1/08

[52] U.S. Cl. ..... 271/155; 271/157

[58] Field of Search ..... 271/157, 154, 155, 215, 271/163

[56] References Cited

U.S. PATENT DOCUMENTS

| | | | |
|---|---|---|---|
| 3,902,713 | 9/1975 | Von Luhmann et al. | 271/154 |
| 3,955,811 | 5/1976 | Gibson | 271/9 |
| 4,052,051 | 10/1977 | Maseneau | 271/155 X |
| 4,245,830 | 1/1981 | Fischte | 271/164 |
| 4,390,175 | 6/1983 | Takahashi | 271/157 |
| 4,466,604 | 8/1984 | Kishimoto et al. | 271/111 |

*Primary Examiner*—Richard A. Schacher

*Attorney, Agent, or Firm*—H. Fleischer; J. E. Beck; R. Zibelli

[57] ABSTRACT

An apparatus in which the loading and unloading of sheets on a tray used in a printing machine is facilitated. The uppermost sheet of the stack of sheets on the tray is continuously maintained at a preselected level as additional sheets are loaded on the tray or removed therefrom. This optimizes the operator access level and minimizes the delay time associated with the tray moving from the sheet feeding position to the operator access level.

25 Claims, 2 Drawing Sheets

SHEET HANDLING APPARATUS

Figure 1:
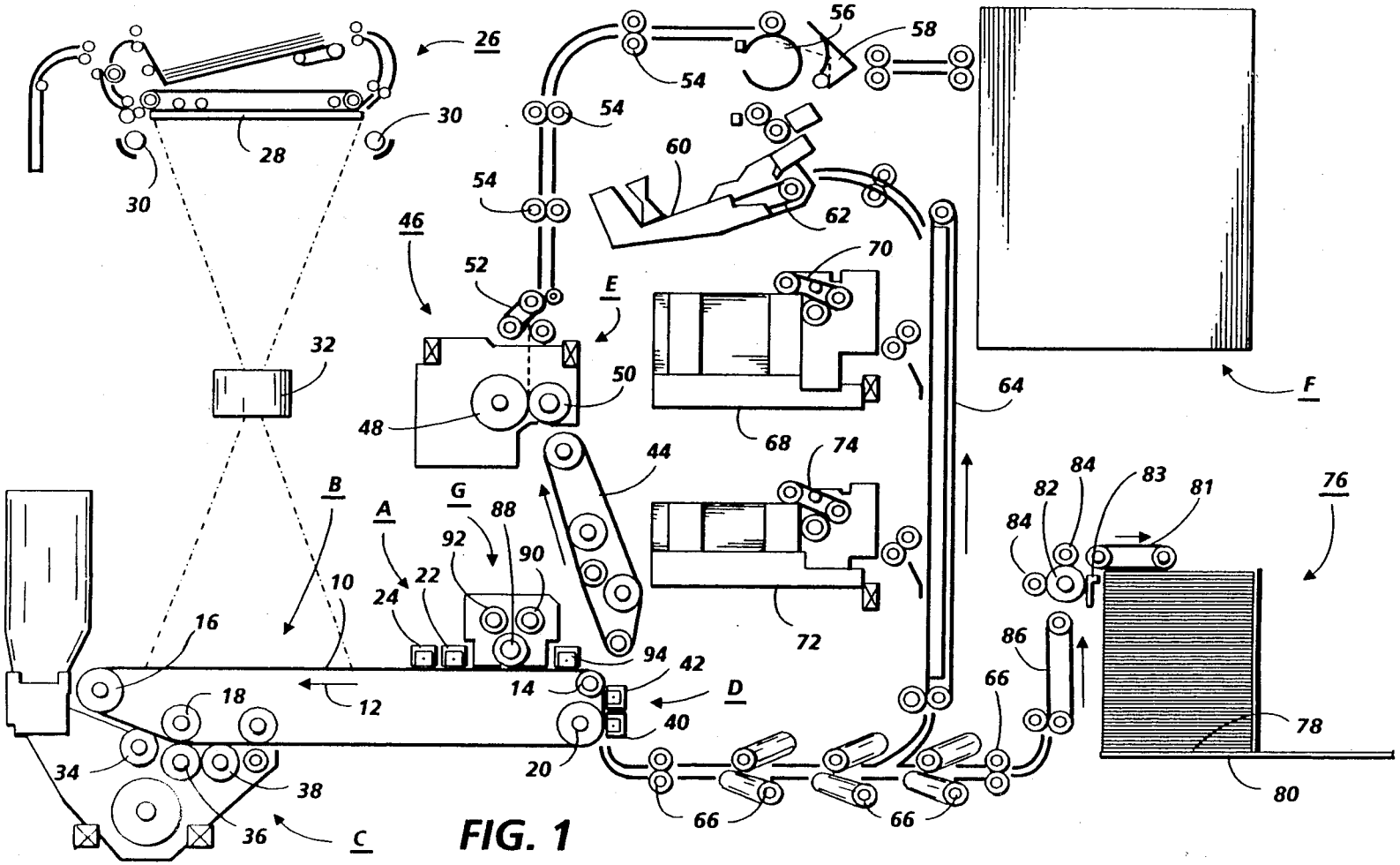

This invention relates generally to an electrophotographic printing machine, and more particularly concerns a sheet handling apparatus for loading and unloading copy sheets used therein.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In a high speed commercial printing machine of the foregoing type, large volumes of copy sheets are fed from storage to the transfer station of the printing machine where the toner powder image is transferred to the copy sheet. Frequently, the copy sheets are stored on a elevator type of sheet feeding tray. The tray is mounted on a frame and moves vertically from a sheet feeding position to a sheet loading and unloading position. The tray descends to its lowermost position where copy sheets are loaded or unloaded therefrom. After the copy sheets are loaded in the tray, the tray ascends to its uppermost position for sheet feeding. High capacity printing machines require large amounts of copy sheets. For example, a fully loaded tray may be loaded with several reams of paper with each ream containing five hundred sheets. This will require the tray to descend to a position very close to the floor. Under these circumstances, the operator may have to load the reams of paper when the tray is spaced about eight inches from the floor. In order to load copy sheets, the operator must wait for the tray to descend from the sheet feeding position to the sheet loading position. With large amounts of copy sheets being loaded on the tray, this wait time can be about twenty seconds. The problem of relatively long wait times and the necessity of loading the copy sheets at a position close to the floor are human factors problems which increase machine downtime and the difficulty of loading copy sheets therein.

Various approaches have been devised for loading copy sheets in a printing machine. The following disclosures appear to be relevant:

U.S. Pat. No. 3,902,713
Patentee: Von Luhmann et al.
Issued: Sept. 2, 1975
U.S. Pat. No. 3,955,811
Patentee: Gibson
Issued May 11, 1976
U.S. Pat. No. 4,466,604
Patentee: Kishimoto et al.

Issued: Aug. 21, 1984

The relevant portions of the foregoing patents may be summarized as follows:

Von Luhmann et al. discloses a lift table controlled by a photoelectric stack height detection device. As sheets are fed from the stack, the photoelectric device raises the lift table to position the stack at the appropriate sheet feeding level.

Gibson describes a paper stack height control in a multibin copier comprising a sensing switch for sensing the top of each non-used stack. Changes in the height of the paper stack cause the stack's elevator platform to move in order to maintain a constant position.

Kishimoto et al. discloses an elevator type paper feeding apparatus comprising a moveable paper tray, a photosensor for detecting paper in the moveable tray and a time delay device to prevent copying until the tray has reached its fully raised position.

In accordance with one aspect of the present invention, there is provided an apparatus for facilitating the loading and unloading of sheets on a tray used in a printing machine The apparatus includes means for moving the tray to control the position thereof. Means detect the position of at least one sheet of the stack of sheets on the tray and control the moving means to move the uppermost sheet of the stack of sheets on the tray to a selected position as sheets are added or removed from the tray to optimize operator loading and unloading of sheets on the tray.

Pursuant to another aspect of the features of the present invention, there is provided an electrophotographic printing machine of the type having a latent image developed on a photoconductive member and in which the developed image is transferred to a copy sheet with successive copy sheets being supplied for a supply source thereof. The printing machine includes a tray arranged to have a stack of copy sheets disposed thereon. Means move the tray to control the position thereof Means are provided for detecting the position of at least one sheet of the stack of sheets on the tray and for controlling the moving means to move the uppermost sheet of the stack of sheets on said tray to a selected position as sheets are added or removed from said tray to optimize operator loading and unloading of sheets on the tray.

Still another aspect of the present invention provides a method of loading and unloading sheets from a tray in a printing machine. The method includes the steps of moving the tray to control the position thereof. The position of at least one sheet of the stack of sheets on the tray is detected and the step of moving controlled to move the uppermost sheet of the stack of sheets on the tray to a selected position as sheets are added or removed from the tray to optimize operator loading and unloading of sheets on the tray.

Figure 2:
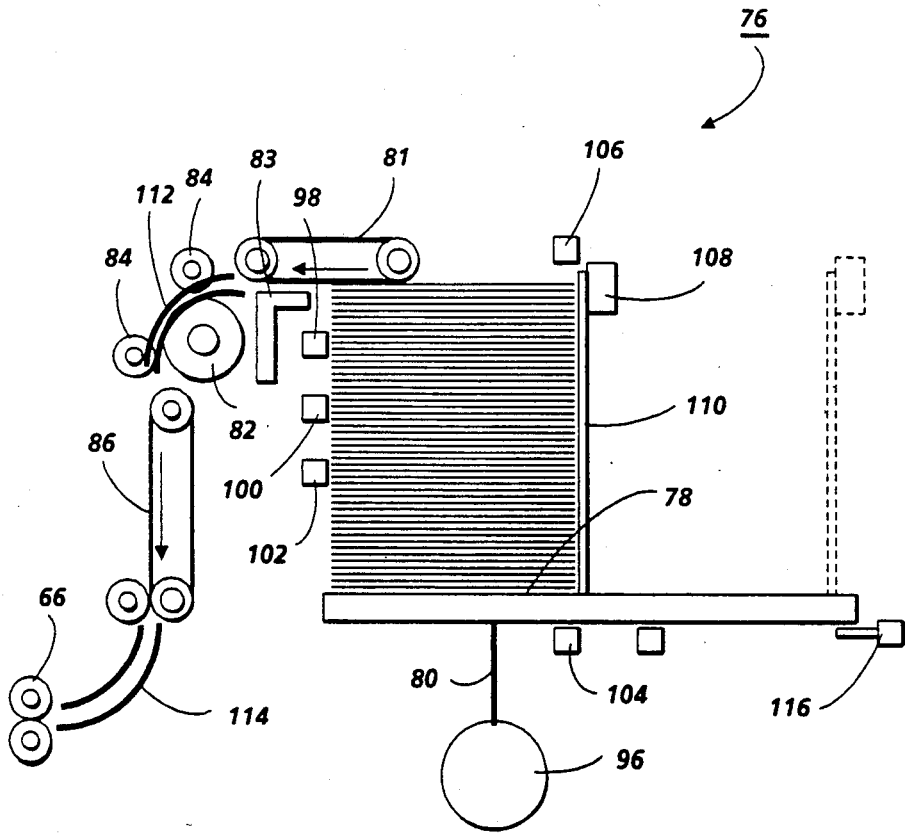

Other aspects of the present invention will become apparent as the following description proceeds and upon reference to the drawings, in which:

FIG. 1 is a schematic elevational view depicting an illustrative electrophotographic printing machine incorporating the sheet handling apparatus of the present invention therein; and FIG. 2 is a schematic elevational view showing the sheet handling apparatus used in the FIG. 1 printing machine.

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the sheet handling apparatus of the present invention may be employed in a wide variety of devices and is not specifically limited in its application to the particular embodiment depicted herein.

Referring to FIG. 1 of the drawings, the electrophotographic printing machine employs a photoconductive belt 10. Preferably, the photoconductive belt 10 is made from a photoconductive material coated on a ground layer, which, in turn, is coated on a anti-curl backing layer. The photoconductive material is made from a transport layer coated on a selenium generator layer. The transport layer transports positive charges from the generator layer. The generator layer is coated on an interface layer. The interface layer is coated on the ground layer made from a titanium coated Mylar. The interface layer aids in the transfer of electrons to the ground layer. The ground layer is very thin and allows light to pass therethrough. Other suitable photoconductive materials, ground layers, and and anti-curl backing layers may also be employed. Belt 10 moves in the direction of arrow 12 to advance successive portions sequentially through the various processing stations disposed about the path of movement thereof. Belt 10 is entrained about stripping roller 14, tensioning roller 16, idler roller 18, and drive roller 20. Stripping roller 14 and idler roller 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices, indicated generally by the reference numerals 22 and 24 charge the photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of the photoconductive surface is advanced through imaging station B. At imaging station B, a document handling unit, indicated generally by the reference numeral 26, is positioned over platen 28 of the printing machine. Document handling unit 26 sequentially feeds documents from a stack of documents placed by the operator face up in a normal forward collated order in the document stacking and holding tray. A document feeder located below the tray forwards the bottom document in the stack to a pair of take-away rollers. The bottom sheet is then fed by the rollers through a document guide to a feed roll pair and belt. The belt advances the document to platen 28. After imaging, the original document is fed from platen 28 by the belt into a guide and feed roll pair. The document then advances into an inverter mechanism and back to the document stack through the feed roll pair. A position gate is provided to divert the document to the inverter or to the feed roll pair. Imaging of a document is achieved by lamps 30 which illuminate the document on platen 28. Light rays reflected from the document are transmitted through lens 32. Lens 32 focuses light images of the original document onto the charged portion of photoconductive belt 10 to selectively dissipate the charge thereon. This records an electrostatic latent image on the photoconductive belt which corresponds to the informational areas contained within the original document. Thereafter, belt 10 advances the electrostatic latent image recorded thereon to development station C.

Development station C has three magnetic brush developer rolls, indicated generally by the reference numerals 34, 36 and 38. A paddle wheel picks up developer material and delivers it to the developer rolls. When developer material reaches rolls 34 and 36, it is magnetically split between the rolls with half the developer material being delivered to each roll. Photoconductive belt 10 is partially wrapped about rolls 34 and 36 to form extended development zones. Developer roll 38 is a cleanup roll. A magnetic roll, positioned after developer roll 38, in the direction of arrow 12, is a carrier granule removal device adapted to remove any carrier granules adhering to belt 10. Thus, rolls 34 and 36 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pre-transfer light from a lamp (not shown) to reduce the attraction between photoconductive belt 10 and the toner powder image. Next, a corona generating device 40 charges the copy sheet to the proper magnitude and polarity so that the copy sheet is tacked to photoconductive belt 10 and the toner powder image attracted from the photoconductive belt to the copy sheet. After transfer, corona generator 42 charges the copy sheet to the opposite polarity to detack the copy sheet from belt 10. Conveyor 44 advances the copy sheet to fusing station E.

Fusing station E includes a fuser assembly, indicated generally by the reference numeral 46 which permanently affixes the transferred toner powder image to the copy sheet. Preferably, fuser assembly 46 includes a heated fuser roller 48 and a pressure roller 50 with the powder image on the copy sheet contacting fuser roller 48. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the copy sheets are fed through a decurler 52. Decurler 52 bends the copy sheet in one direction to put a known curl in the copy sheet and then bends it in the opposite direction to remove that curl.

Forwarding rollers 54 then advance the sheet to duplex turn roll 56. Duplex solenoid gate 58 guides the sheet to the finishing station F or to duplex tray 60. At finishing station F, copy sheets are stacked in a compiler tray and attached to one another to form sets. The sheets are attached to one another by either a binding device or a stapling device. In either case, a plurality of sets of documents are formed in finishing station F. When duplex solenoid gate 58 diverts the sheet into duplex tray 60. Duplex tray 60 provides an intermediate or buffer storage for those sheets that have been printed on one side and on which an image will be subsequently printed on the second, opposed side thereof, i.e. the sheets being duplexed. The sheets are stacked in duplex tray 60 face down on top of one another in the order in which they are copied.

In order to complete duplex copying, the simplex sheets in tray 60 are fed, in seriatim, by bottom feeder 62 from tray 60 back to transfer station D via conveyor 64 and rollers 66 for transfer of the toner powder image to the opposed sides of the copy sheets. Inasmuch as successive bottom sheets are fed from duplex tray 60, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 66. The secondary tray 68 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 70. Sheet feeder 70 is a friction retard feeder utilizing a feed belt and take-away rolls to advance successive copy sheets to transport 64 which advances the sheets to rolls 66 and then to transfer station D.

Copy sheets may also be fed to transfer station D from the auxiliary tray 72. The auxiliary tray 68 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 74. Sheet feeder 74 is a friction retard feeder utilizing a feed belt and take-away rolls to advance successive copy sheets to transport 64 which advances the sheets to rolls 66 and then to transfer station D.

Secondary tray 68 and auxiliary tray 72 are secondary sources of copy sheets. A high capacity feeder, indicated generally by the reference numeral 76, is the primary source of copy sheets. High capacity feeder 76 includes a tray 78 supported on an elevator 80. The elevator is driven by a bidirectional AC motor to move the tray up or down. In the up position, the copy sheets are advanced from the tray to transfer station D. A fluffer and air knife 83 direct air onto the stack of copy sheets on tray 78 to separate the uppermost sheet from the stack of copy sheets. A vacuum pulls the uppermost sheet against feed belt 81. Feed belt 81 feeds successive uppermost sheets from the stack to an take-away drive roll 82 and idler rolls 84. The drive roll and idler rolls guide the sheet onto transport 86. Transport 86 advances the sheet to rolls 66 which, in turn, move the sheet to transfer station station D. Further details of the operation of high capacity feeder 76 will be described hereinafter with reference to FIG. 2.

Invariably, after the copy sheet is separated from the photoconductive belt 10, some residual particles remain adhering thereto. After transfer, photoconductive belt 10 passes beneath corona generating device 94 which charges the residual toner particles to the proper polarity. Thereafter, the pre-charge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 88 and two de-toning rolls 90 and 92, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the the rear of cleaning station G.

The various machine functions are regulated by a controller. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, the controller regulates the various positions of the gates depending upon the mode of operation selected. Thus, when the operator selects the finishing mode, either an adhesive binding apparatus and/or a stapling apparatus wil be be energized and the gates will be oriented so as to advance either the simplex or duplex copy sheets to finishing station F. The detailed operation of high capacity feeder 76 will be described hereinafter with reference to FIG. 2.

Referring now to FIG. 2, the features of high capacity feeder 76 includes a tray 78 supported on an elevator 80. Elevator 80 is driven by a bidirectional AC motor 96. Motor 96 drives elevator 80 to move tray 78 up and down. Tray position sensors 98 and 100 are used to maintain the loading level while the tray is being loaded. Sensor 98 also indicates that there is approximately one-half a ream, i.e. about 250 sheets, in the tray. Sensor 100 also indicates that there is one ream or 500 sheets left in the tray. Tray position sensor 102 is located midway between sensor 100 and down limit switch 104. Sensor 102 provides information to the control system that there is approximately three reams of paper with each ream having about five hundred sheets left in the tray. Up limit switch 106 and down limit switch 104 de-energize motor 96 to prevent the elevator from moving the tray too far in the vertical direction. Stack height switch 108 is mounted on movable rear guide 110 and provides an indication of when the uppermost sheet of the stack is in the sheet feeding position. Switch 108 controls motor 96 to maintain the uppermost sheet of the stack in the sheet feeding position adjacent feed belt 81. Air knife and fluffer 83 direct air onto the stack of copy sheets in the sheet feeding position. There are two fluffers blowing against the lead edge of the stack of copy sheets, and one fluffer blowing against the rear edge of stack of copy sheets. As the top sheet is separated from the remaining sheets in the stack, the vacuum pulls the top sheet against feed belt 81. The air knife is then used to separate the next copy sheet from the remainder of the sheets in the stack as the prior top copy sheet is advanced by feed belt 81 into baffle 112. Take away drive roller 82 cooperates with idler rollers 84 to move the sheet onto vertical transport 86. Transport 86 moves the sheet into baffle 114 which guides the sheet into the nip defined by roller pairs 66. As shown in FIG. 1, roller pairs 66 move the sheet to transfer station B. The high capacity feeder tray 78 is lowered to the operator access level in the event of sheet jam, low paper signal or operator down command. Assuming that tray 78 is positioned so that the uppermost sheet of the stack is in the sheet feed position and a low paper signal is transmitted from switch 106 to the controller, motor 96 is energized to move elevator 80 and tray 78 in a downward direction until sensor 98 indicates the absence of sheets. Motor 96 will continue to drive elevator 80 to move tray 78 downwardly for about 100 milliseconds. At this time sensor 100 indicates the presence of copy sheets and sensor 98 indicates the absence of copy sheets. Sensors 98 and 100 are photodetectors. Thus, sensor 98 is unblocked and sensor 100 is blocked by the copy sheets. Motor 96 is then de-energized. When motor 96 starts to drive elevator 80 to move tray 78 downwardly, solenoid 116 is energized to cause the tray release latch to drive over center so as to eject tray 78 facilitating loading of copy sheets thereon. The operator access level is midway between sensor 98 and 100 and about 18 inches above the floor. As the operator loads additional sheets on tray 78, sensor 98 becomes blocked. When both sensor 98 and 100 are blocked motor 96 is energized to drive the elevator so as to move the tray downwardly. There is a delay of about 2 seconds before the elevator moves tray 78 to allow registration of the stack of copy sheets. When sensor 98 is unblocked, motor 96 is de-energized. In this way, the top or uppermost sheet of the stack is continuously maintained at the operator access level facilitating loading of sheets thereon. In the event copy sheets are being unloaded from tray 78, both sensors 98 and 100 become unblocked. When sensor 100 is unblocked, motor 96 is energized to drive elevator 80 so as to move tray 78 upwardly. Motor 96 is de-energized when sensor 100 is blocked. In this way, the uppermost sheet of the stack is maintained at the operator access level as sheet are loaded or unloaded from tray 78. As is shown in FIG. 2, sensor 98 is vertically spaced from sensor 100 with the operator access level being preselected at about midway between the sensors and about eighteen inches from the floor.

It should be noted that the operator may elect to deselect this feature and allow the tray to move downwardly to the floor for loading and unloading copy sheets thereon.

In recapitulation, the sheet handling apparatus of the present invention continuously maintains the uppermost sheet of a stack of sheets at a constant level as sheets are added or removed therefrom. The position is selected to account for the human factors requirements associated with loading and unloading reams of sheets by the operator in conjunction with reducing the lag time required for the tray to reach the sheet loading or unloading position.

It is, therefore, evident that there has been provided, in accordance with the present invention, a sheet handling apparatus that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. An apparatus for facilitating the loading and unloading of sheets on a tray used in a printing machine with the tray being adapted to move between a first position adjacent a sheet feeder and a second position remote therefrom, including:

means for moving the tray to control the position thereof;

means for detecting the position of at least one sheet of the stack of sheets on the tray and controlling said moving means to move the uppermost sheet of the stack of sheets on the tray to a selected position intermediate the first position and the second position with the tray moving toward the second position as sheets are loaded thereon and toward the first position as sheets are removed from the tray; and means for ejecting the tray in response to said detecting means indicating that the uppermost sheet of the stack of sheets on the tray is at the selected position to optimize operator loading and unloading of sheets on the tray at the selected position.

2. An apparatus according to claim 1, wherein said detecting means includes:

first position sensing means for transmitting a signal when at least one sheet of the stack on the tray is detected; and second position sensing means, spaced from said first position sensing means, for transmitting a signal when at least one sheet of the stack on the tray is detected.

3. An apparatus according to claim 2, wherein said moving means, responsive to said second position sensing means detecting the presence of at least one sheet of the stack and said first position sensing means detecting the absence of the sheet, is de-energized positioning the uppermost sheet of the stack on tray at the selected position intermediate said first position sensing means and said second position sensing means.

4. An apparatus according to claim 3, wherein said moving means moves the tray toward said second position sensing means in response to said first position sensing means indicating the presence of at least one sheet as the operator loads additional sheets on the tray so as to move the uppermost sheet of the stack to the selected position.

5. An apparatus according to claim 4, wherein said moving means moves the tray toward said first position sensing means in response to said second position sensing means indicating the absence of a sheet as the operator removes sheets from the tray so as to move the uppermost sheet of the stack to the selected position.

6. An apparatus according to claim 5, wherein said ejecting means is actuated after said first position sensing means indicates the presence of the sheet.

7. An apparatus according to claim 6, wherein:

said first position sensing means includes a first photodetector; and said second position sensing means includes a second photodetector.

8. An apparatus according to claim 7, wherein said first photodetector is vertically spaced from said second photodetector.

9. An apparatus according to claim 8, wherein said moving means moves said tray in a vertical direction.

10. An electrophotographic printing machine of the type in which a latent image is developed on a photoconductive member and the developed image transferred to a copy sheet with successive copy sheets being supplied from a supply source thereof, wherein the improvement includes:

a tray arranged to have a stack of copy sheets disposed thereon, said tray being adapted to move between a first position adjacent a sheet feeder and a second position remote therefrom;

means for moving said tray to control the position thereof;

means for detecting the position of at least one sheet of the stack of sheets on said tray and controlling said moving means to continuously move the uppermost sheet of the stack of sheets on said tray to a selected position intermediate the first position and the second position with the tray moving toward the second position as sheets are loaded thereon and toward the first position as sheets are removed from said tray; and means for ejecting the tray in response to said detecting means indicating that the uppermost sheet of the stack of sheets on the tray is at the selected position to optimize operator loading and unloading of sheets on said tray at the selected position.

11. A printing machine according to claim 10, wherein said detecting means includes:

first position sensing means for transmitting a signal when at least one sheet of the stack is detected; and second position sensing means, spaced from said first position sensing means, for transmitting a signal when at least one sheet of the stack is detected.

12. A printing machine according to claim 11, wherein said moving means, responsive to said second position sensing means detecting the presence of at least one sheet and said first position sensing means detecting the absence of the sheet, is de-energized positioning the uppermost sheet of the stack on said tray at the selected position intermediate said first position sensing means and said second position sensing means.

13. A printing machine according to claim 12, wherein said moving means moves the tray toward said second position sensing means in response to said first position sensing means indicating the presence of at least one sheet as the operator loads additional sheets on said tray so as to move the uppermost sheet to the selected position.

14. A printing machine according to claim 13, wherein said moving means moves the tray toward said first position sensing means in response to said second position sensing means indicating the absence of the sheet as the operator removes sheets from said tray so as to move the uppermost sheet to the selected position.

15. A printing machine according to claim 14, wherein said ejecting means is actuated after said first position sensing means indicates the presence of the sheet.

16. A printing machine according to claim 15, wherein:

said first position sensing means includes a first photodetector; and said second position sensing means includes a second photodetector.

17. A printing machine according to claim 16, wherein said first photodetector is vertically spaced from said second photodetector.

18. A printing machine according to claim 17, wherein said moving means moves said tray in a vertical direction.

19. A method of loading and unloading sheets from a tray in a printing machine with the tray being adapted to move between a first position adjacent a sheet feeder and a second position remote therefrom, including the steps of:

moving the tray to control the position thereof;

detecting the position of at least one sheet of the stack of sheets on the tray and controlling said step of moving to move the uppermost sheet of the stack of sheets on the tray to a selected position intermediate the first position and the second position with the tray moving toward the second position as sheets are loaded thereon and toward the first position as sheets are added from the tray; and ejecting the tray in response to said step of detecting indicating that the uppermost sheet of the stack of sheets on the tray is at the selected position to optimize operator loading and unloading of sheets on the tray at the selected position.

20. A method according to claim 19, wherein said step of detecting includes the steps of:

sensing, at a first position, the presence of at least one sheet of the stack on the tray and transmitting a signal indicative thereof; and sensing, at a second position spaced from the first position, the presence of at least one sheet of the stack on the tray and transmitting a signal indicative thereof.

21. A method according to claim 20, wherein said step of moving includes maintaining the uppermost sheet of the stack on the tray at the selected position in which said step of sensing at the first position senses the absence of the sheet and said step of sensing at the second position senses the presence of at least one sheet of the stack.

22. A method according to claim 21, wherein said step of moving moves the tray toward said second position in response to said step of sensing, at the first position, the presence of at least one sheet as the operator loads additional sheets on the tray so as to move the uppermost sheet of the stack to the selected position.

23. A method according to claim 22, wherein said step of moving means moves the tray toward the first position in response to said step of sensing, at the second position, the absence of the sheet as the operator removes sheets from the tray so as to move the uppermost sheet of the stack to the selected position.

24. A method according to claim 23, wherein said step of ejecting occurs after said step of sensing at the first position indicates the presence of the sheet.

25. A method according to claim 24, wherein said step of moving moves the tray in a vertical direction.

* * * * *